US008040297B2

(12) United States Patent
Chung

(10) Patent No.: US 8,040,297 B2
(45) Date of Patent: Oct. 18, 2011

(54) EMISSION CONTROL DRIVER AND ORGANIC LIGHT EMITTING DISPLAY HAVING THE SAME

(75) Inventor: Bo-Yong Chung, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 977 days.

(21) Appl. No.: 11/374,974

(22) Filed: Mar. 15, 2006

(65) Prior Publication Data

US 2006/0244388 A1 Nov. 2, 2006

(30) Foreign Application Priority Data

Apr. 29, 2005 (KR) ..... 10-2005-0036413

(51) Int. Cl.
*G09G 3/30* (2006.01)

(52) U.S. Cl. ..... 345/76; 345/77; 315/169.3

(58) Field of Classification Search ..... 345/76–86; 315/169.3

See application file for complete search history.

(56) References Cited

U.S. PATENT DOCUMENTS

| | | | | |
|---|---|---|---|---|
| 6,348,906 | B1 * | 2/2002 | Dawson et al. | 345/82 |
| 6,809,710 | B2 * | 10/2004 | Prache et al. | 345/82 |
| 7,057,588 | B2 * | 6/2006 | Asano et al. | 345/76 |
| 7,180,486 | B2 * | 2/2007 | Jeong | 345/82 |
| 7,187,351 | B2 * | 3/2007 | Kwon | 345/82 |
| 7,286,106 | B2 * | 10/2007 | Komiya et al. | 345/82 |
| 7,327,357 | B2 * | 2/2008 | Jeong | 345/204 |
| 7,333,079 | B2 * | 2/2008 | Shibusawa et al. | 345/76 |
| 7,414,599 | B2 * | 8/2008 | Chung et al. | 345/76 |
| 7,605,789 | B2 * | 10/2009 | Uchino et al. | 345/92 |
| 7,612,747 | B2 * | 11/2009 | Huang et al. | 345/76 |
| 7,710,368 | B2 * | 5/2010 | Chung | 345/82 |
| 2002/0196212 | A1 * | 12/2002 | Nishitoba et al. | 345/76 |
| 2004/0056604 | A1 * | 3/2004 | Shih et al. | 315/169.2 |
| 2004/0217925 | A1 * | 11/2004 | Chung et al. | 345/76 |
| 2005/0017934 | A1 * | 1/2005 | Chung et al. | 345/82 |
| 2006/0066532 | A1 * | 3/2006 | Jeong | 345/76 |
| 2006/0232521 | A1 * | 10/2006 | Jang et al. | 345/76 |

FOREIGN PATENT DOCUMENTS

KR 10-2005-0025510 3/2005

* cited by examiner

*Primary Examiner* — Jason Mandeville

(74) *Attorney, Agent, or Firm* — H.C. Park & Associates, PLC

(57) ABSTRACT

An emission control driver that applies an emission control signal for controlling an emission operation of a pixel circuit is provided. The emission control driver includes an emission control circuit with a plurality of transistors and a capacitor placed between a positive power supply voltage and a negative power supply voltage. When the driver is fabricated in an organic light emitting display (OLED), the transistors send a high level or low level emission control signal to a pixel circuit in response to a scan signal, and can be the same type transistors as the pixel circuit transistors. Further, the emission control driver may include a transistor for interrupting the positive power supply voltage in response to an initializing signal to initialize a capacitor of the pixel circuit.

14 Claims, 5 Drawing Sheets

EMISSION CONTROL DRIVER AND ORGANIC LIGHT EMITTING DISPLAY HAVING THE SAME

CROSS REFERENCE TO RELATED APPLICATION

This application claims priority to and the benefit of Korean Patent Application No. 2005-0036413, filed on Apr. 29, 2005, which is hereby incorporated by reference for all purposes as if fully set forth herein.

BACKGROUND OF THE INVENTION

1. Field of the Invention

The present invention relates to an emission control driver having a simple circuit for generating an emission control signal, and an organic light emitting display (OLED) having the same.

2. Discussion of the Background

Where an emission control transistor for controlling the emission of a light emitting device is added to a pixel circuit, an emission control driver must transmit an emission control signal to the emission control transistor.

A conventional emission control driver has been separately fabricated and mounted to a substrate with a pixel portion by a tape carrier package (TCP) or similar method in a subsequent manufacturing step. Thus, the additional step lowers production yield, complicates the fabrication process, and increases production cost. To solve these problems, an OLED with an emission control driver integrated into a panel has been developed.

FIG. 1 shows the configuration of a conventional OLED having an emission control driver integrated into a panel.

Referring to FIG. 1, the OLED includes a scan driver 400, a data driver 500, and a panel 100. Further, the panel 100 includes a pixel portion 300, and an emission control driver 200.

The pixel portion 300 includes pixel circuits 310 that are connected to scan lines S1 through Sn, data lines D1 through Dm and emission control lines E1 though En. The pixel circuits 310 are arranged in a matrix form and display a predetermined image.

The scan driver 400 sequentially supplies scan signals to scan lines S1 through Sn formed in the pixel portion 300.

The data driver 500 supplies a predetermined data signal to data lines D1 through Dn formed in the pixel portion 300.

The emission control driver 200 supplies an emission control signal to emission control lines E1 through En formed in the pixel portion 300, thereby controlling an emission operation of the pixel portion 300.

The pixel portion 300 and the emission control driver 200 are integrated in the panel 100. Specifically, a thin film transistor (TFT) array for driving pixels and an emission control circuit 210 of the emission control driver 200 are integrated into the panel 100.

Generally, the TFT used as a switching device in the pixel portion 300 uses poly-silicon with high mobility to form a channel. In the emission control driver 200, a transistor used as the switching device must also have a fast response time, so the poly-silicon with high mobility can effectively form the channel.

Therefore, the emission control circuit 210 of the emission control driver 200 and the pixel-driving transistor could be made of the same silicon, and a switching transistor with fast response time would be formed in a simplified fabrication process since there would be no need to connect the pixel portion 300 with the emission control driver 200.

However, the conventional emission control driver 200 is not composed of only a p-type metal oxide semiconductor field effect transistor (MOSFET), which is usually used in the pixel portion 300. Therefore, it would not be possible to fabricate the emission control driver 200 and the transistor of the pixel portion 300 in the same process.

Additionally, where the emission control driver 200 has been composed of a shift register, many control signals, such as CLK or CLKB, are required to drive the shift register. However, such control signals are applied from an external controller, so the layout becomes complicated. Furthermore, the external controller results in additional power consumption by the panel.

SUMMARY OF THE INVENTION

This invention provides an emission control driver that generates an emission control signal using a scan signal output from a scan driver without an external control signal.

The present invention also provides an OLED with an emission control driver fabricated with the same transistor type as the thin film transistor formed in the pixel portion of the OLED.

Additional features of the invention will be set forth in the description which follows, and in part will be apparent from the description, or may be learned by practice of the invention.

The present invention discloses an emission control driver comprising a first signal transmitting portion for selectively receiving a positive power supply voltage in response to a first scan signal and a second scan signal, a second signal transmitting portion for selectively receiving a negative power supply voltage in response to a third scan signal, and an output portion connected between the the first signal transmitting portion and second signal transmitting portion to selectively output the positive power supply voltage or negative power supply voltage in response to the first scan signal, second scan signal, and third scan signal.

The present invention also discloses an OLED with a pixel portion for displaying a predetermined image thereon, a scan driver for supplying a scan signal to the pixel portion, a data driver for supplying a data signal to the pixel portion, and an emission control driver fabricated on the OLED panel for supplying an emission control signal to the pixel portion to control an emission operation of the pixel portion. Further, the transistors contained in the emission control driver are of the same type as the transistors contained in the pixel portion of the OLED.

The present invention also discloses a method for emitting light from an organic light emitting display, where the method includes receiving a scan signal to turn on a first transistor, transmitting a voltage signal through the first transistor, transmitting an emission control signal substantially equivalent to the voltage signal to turn on a transmission control transistor, and supplying current through the transmission control transistor to an organic light emitting display diode to emit light.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
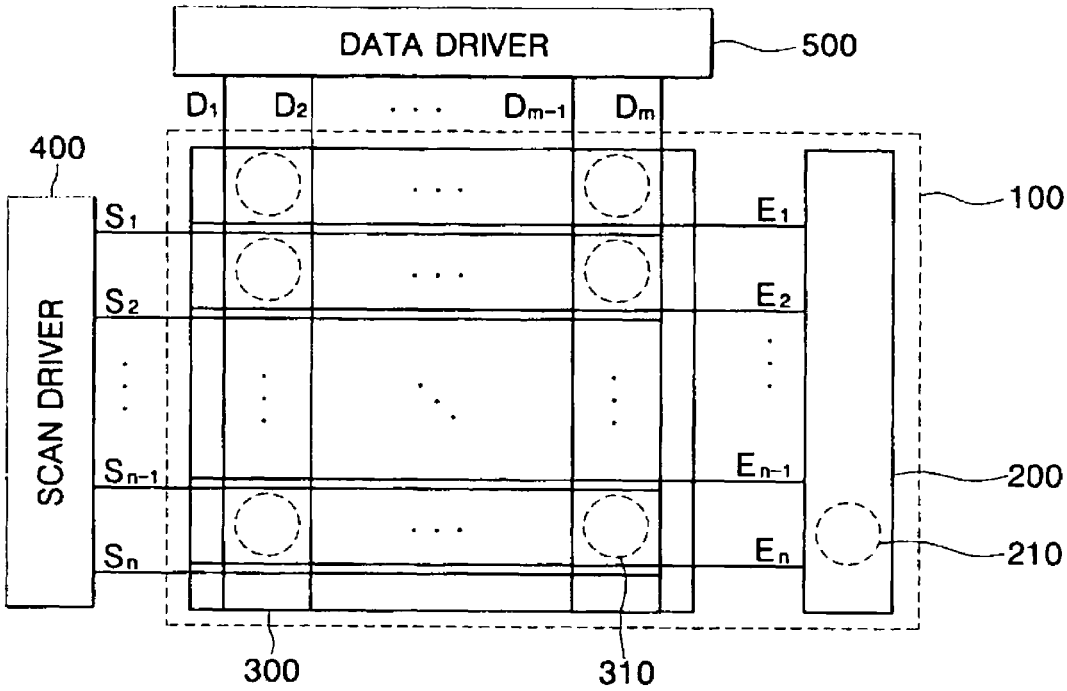
FIG. 1 (PRIOR ART)
FIG. 1 shows the configuration of a conventional OLED including an emission control driver integrated into a panel.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity.

In the following descriptions, when a part is illustrated as being connected or coupled to another part, the part may be directly connected or coupled to the other part, or a third part may be interposed there between. Further, parts irrelevant to the present invention are omitted for clarity, and like reference numerals refer to like elements throughout.

Figure 2:
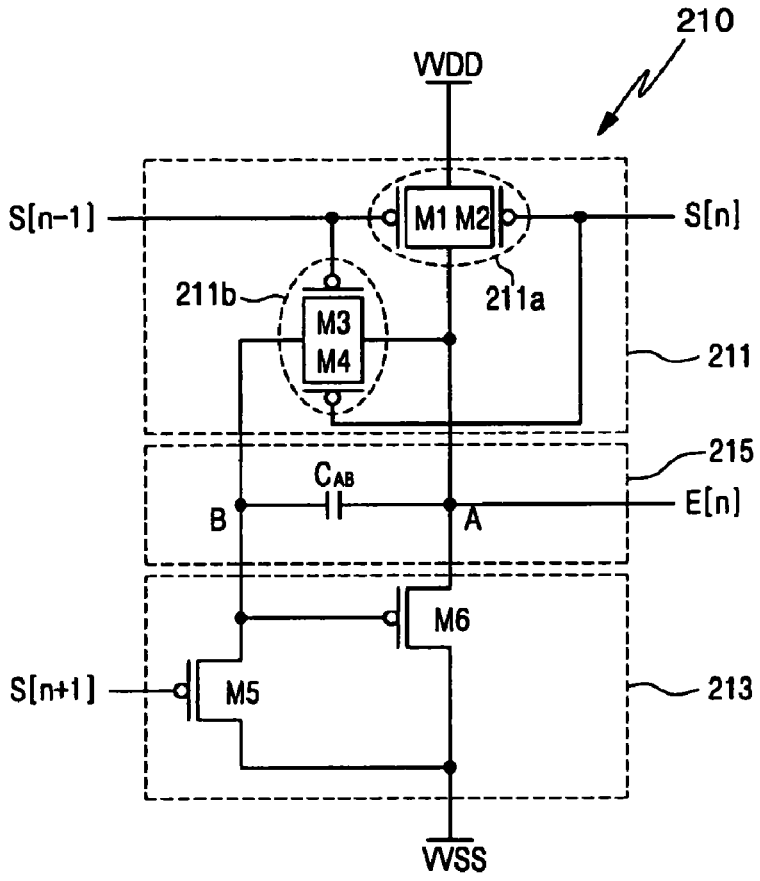
FIG. 2 shows a circuit diagram of an emission control circuit according to a first embodiment of the present invention.

FIG. 2 is a circuit diagram of an emission control circuit according to a first embodiment of the present invention.

For clarity, only emission control circuit 210 for supplying the $n^{th}$ emission control signal is illustrated in FIG. 2.

Referring to FIG. 2, the emission control circuit 210 according to the first embodiment of the present invention includes a first signal transmitting portion 211, an output portion 215 and a second signal transmitting portion 213. A positive power supply voltage VVDD is coupled to the first signal transmitting portion 211, and a negative power supply voltage VVSS is coupled to the second signal transmitting portion 213.

The first signal transmitting portion 211 is coupled between the positive power supply voltage VVDD and the output portion 215, and includes a first switching portion 211*a* for performing ON/OFF operation in response to the $(n-1)^{th}$ and $n^{th}$ scan signals S[n−1] and S[n] to receive and selectively output the positive power supply voltage VVDD; and a second switching portion 211*b* for performing ON/OFF operation in response to the $(n-1)^{th}$ and $n^{th}$ scan signals S[n−1] and S[n] to selectively transmit the positive power supply voltage VVDD from the first switching portion 211*a* to the output portion 215.

The first switching portion 211*a* includes transistors M1 and M2 coupled between the positive power supply voltage VVDD and the output portion 215.

The transistor M1 has a control terminal to receive the $(n-1)^{th}$ scan signal S[n−1], an input terminal connected to the positive power supply voltage VVDD, and an output terminal connected to the first electrode A of the output portion 215.

The transistor M2 has a control terminal to receive the $n^{th}$ scan signal S[n], an input terminal connected to the positive power supply voltage VVDD, and an output terminal connected to the first electrode A of the output portion 215.

The second switching portion 211*b* includes transistors M3 and M4 coupled to the first switching portion 211*a* and the output portion 215.

The transistor M3 has a control terminal to receive the $(n-1)^{th}$ scan signal S[n−1], an input terminal connected to the output terminals of the transistors M1 and M2 of the first switching portion 211*a*, and an output terminal connected to a second electrode B of the output portion 215.

The transistor M4 has a control terminal to receive the $n^{th}$ scan signal S[n], an input terminal connected to the output terminals of the transistors M1 and M2 of the first switching portion 211*a*, and an output terminal connected to the second electrode B of the output portion 215.

The second signal transmitting portion 213 is coupled to the negative power supply voltage VVSS and the output portion 215, and includes a first switching transistor M5 for performing ON/OFF operation in response to the $(n+1)^{th}$ scan signal S[n+1], and a second switching transistor M6 for performing ON/OFF operation in response to an output signal of the first switching transistor M5.

The first switching transistor M5 has a control terminal to receive the $(n+1)^{th}$ scan signal S[n+1], an input terminal connected to the negative power supply voltage VVSS, and an output terminal connected to the second electrode B of the output portion 215.

The second switching transistor M6 has a control terminal to receive the output signal of the first switching transistor M5, an input terminal connected to the negative power supply voltage VVSS, and an output terminal connected to the first electrode A of the output portion 215.

The output portion 215 is coupled to the first signal transmitting portion 211 and the second signal transmitting portion 213, and includes a capacitor CAB.

The capacitor CAB has a first electrode A and a second electrode B. First electrode A is coupled to the output terminal of the first switching portion 211*a*, the input terminal of the second switching portion 211*b*, the output terminal of the second switching transistor M6. Second electrode B is coupled to the output terminal of the second switching portion 211*b*, the output terminal of the first switching transistor M5, and the control terminal of the second switching transistor M6.

In an embodiment of the present invention, the positive power supply voltage VVDD and the negative power supply voltage VVSS must have a potential difference sufficient to to turn the emission control transistors of the pixel portion on and off. As shown in the embodiments described herein, all transistors are p-type MOSFETs, but they are not limited thereto. Alternatively, all transistors may be n-type MOSFETs. Further, according to an embodiment of the present invention, the $(n-1)^{th}$ scan signal, the $n^{th}$ scan signal and the $(n+1)^{th}$ scan signal can be applied as separate control signals.

Figure 3:
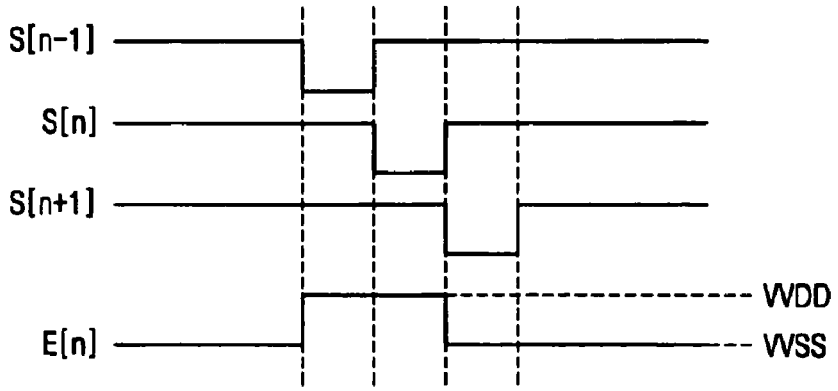
FIG. 3 shows a timing diagram illustrating an operation of the emission control circuit of FIG. 2.

The operation of the emission control circuit 210 according to the first embodiment of the present invention will be described with reference to FIG. 2 and FIG. 3.

First, when the $(n-1)^{th}$ scan signal S[n−1] having a low level is applied, the transistors M1 and M3 are turned on, and transistors M2, M4, M5, and M6 remain off. Second electrode B of the capacitor CAB receives the power supply voltage VVDD equal to the voltage applied to the first electrode A. Thus, an emission control signal having a high level, corresponding to the positive power supply voltage VVDD, is generated in the first electrode A of the capacitor CAB.

Next, when the $n^{th}$ scan signal Sn having a low level is applied, the transistors M2 and M4 are turned on. Transistors M1, M3 turn off, and transistors M5 and M6 remain off. The voltage applied at both the electrodes A and B of the capacitor CAB remains equal to the positive power supply voltage VVDD even though the transistors M1 and M3 are turned off. The emission control signal having a high level, corresponding to the positive power supply voltage VVDD, is again generated in the first electrode A of the capacitor CAB.

Last, when the $(n+1)^{th}$ scan signal S[n+1] having a low level is applied, transistors M1, M2, M3 and M4 are turned off and transistor M5 is turned on. Therefore, the negative power supply voltage VVSS is applied to the second electrode B of the capacitor CAB, and the control terminal of the transistor M6, thereby turning on the transistor M6. Thus, the negative power supply voltage VVSS is also applied to the first electrode A of the capacitor CAB, so that the emission control signal having a low level corresponding to the negative power supply voltage VVSS is generated in the first electrode A of the capacitor CAB.

Consequently, the emission control circuit 210 generates the high level emission control signal, corresponding to the positive power supply voltage VVDD, when the $(n-1)^{th}$ and $n^{th}$ scan signals S[n−1] and S[n] are applied with low levels, and generates the low level emission control signal, corresponding to the negative power supply voltage VVSS, when the $(n+1)^{th}$ scan signal S[n+1] is applied with a low level.

Figure 4:
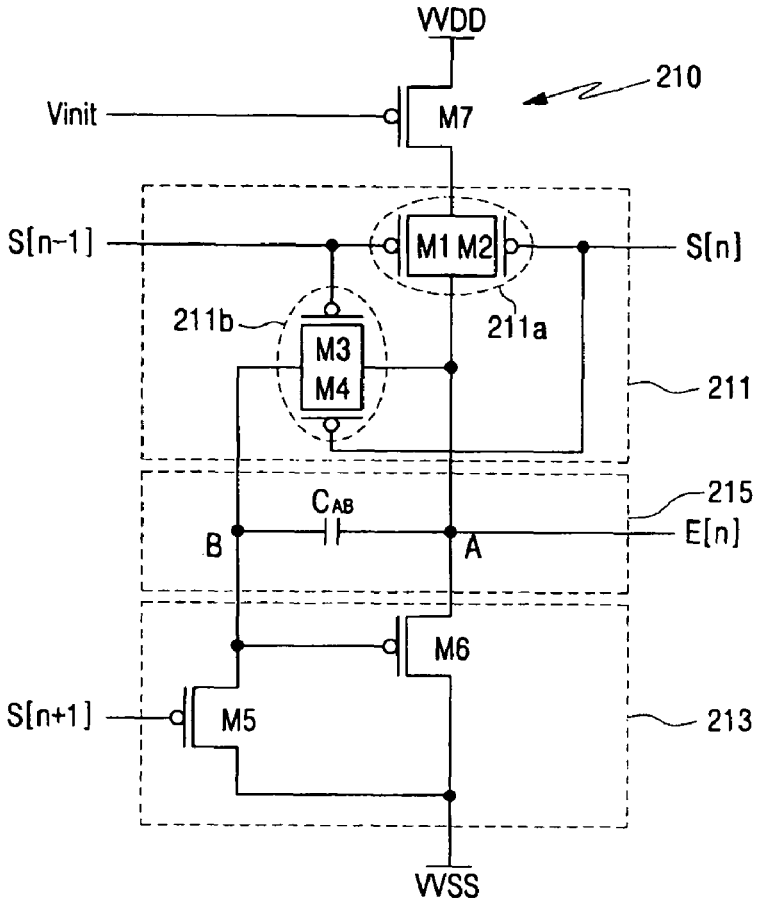
FIG. 4 shows a circuit diagram of an emission control circuit according to a second embodiment of the present invention.

Referring to FIG. 4, the emission control circuit 210 according to the second embodiment of the present invention includes an initializing switching device M7, a first signal transmitting portion 211, an output portion 215, and a second signal transmitting portion 213.

The initializing switching device M7 is coupled to a positive power supply voltage VVDD and the first signal transmitting portion 211, and includes an initializing transistor M7. The first signal transmitting portion 211 is electrically connected to or disconnected from the positive power supply voltage VVDD in response to an initializing signal Vinit into control terminal of initializing transistor M7.

The initializing transistor M7 has a control terminal to receive the initializing signal Vinit, an input terminal connected to the positive power supply voltage VVDD, and an output terminal connected to input terminals of transistors M1 and M2 of a first switching portion 211*a*.

The first signal transmitting portion 211 is coupled to the initializing transistor M7 and the output portion 215, and includes the first switching portion 211*a* for performing ON/OFF operation in response to the $(n-1)^{th}$ and $n^{th}$ scan signals S[n−1] and S[n] to receive and selectively output an output signal of the initializing transistor M7; and a second switching portion 211*b* for performing ON/OFF operation in response to the $(n-1)^{th}$ and $n^{th}$ scan signals S[n−1] and S[n] to selectively transmit the output signal of the initializing transistor M7 from the first switching portion 211*a* to the output portion 215.

The first switching portion 211*a* includes the transistors M1 and M2 coupled to the initializing transistor M7 and the output portion 215.

The transistor M1 has a control terminal to receive the $(n-1)^{th}$ scan signal S[n−1], an input terminal connected to the output terminal of the initializing transistor M7, and an output terminal connected to a first electrode A of the output portion 215.

The transistor M2 has a control terminal to receive the $n^{th}$ scan signal S[n], an input terminal connected to the output terminal of the initializing transistor M7, and an output terminal connected to the first electrode A of the output portion 215.

The second switching portion 211*b* includes transistors M3 and M4 coupled to the first switching portion 211*a* and the output portion 215.

The transistor M3 has a control terminal to receive the $(n-1)^{th}$ scan signal S[n−1], an input terminal connected to the output terminals of the transistors M1 and M2 of the first switching portion 211*a*, and an output terminal connected to a second electrode B of the output portion 215.

The transistor M4 has a control terminal to receive the $n^{th}$ scan signal S[n], an input terminal connected to the output terminals of the transistors M1 and M2 of the first switching portion 211*a*, and an output terminal connected to the second electrode B of the output portion 215.

The second signal transmitting portion 213 is coupled to a negative power supply voltage VVSS and the output portion 215, and includes a first switching transistor M5 for performing ON/OFF operation in response to the $(n+1)^{th}$ scan signal S[n+1], and a second switching transistor M6 for performing ON/OFF operation in response to an output signal from the first switching transistor M5.

The first switching transistor M5 has a control terminal to receive the $(n+1)^{th}$ scan signal S[n+1], an input terminal connected to the negative power supply voltage VVSS, and an output terminal connected to the second electrode B of the output portion 215.

The second switching transistor M6 has a control terminal to receive the output signal from the first switching transistor M5, an input terminal connected to the negative power supply voltage VVSS, and an output terminal connected to the first electrode A of the output portion 215.

The output portion 215 is coupled to the first signal transmitting portion 211 and the second signal transmitting portion 213, and includes a capacitor CAB.

The capacitor CAB has a first electrode A and a second electrode B. First electrode A is connected to the output terminal of the first switching portion 211*a*, the input terminal of the second switching portion 211*b*, and the output terminal of the second switching transistor M6. Second electrode B is connected to the output terminal of the second switching portion 211*b*, the output terminal of the first switching transistor M5, and the control terminal of the second switching transistor M6.

Figure 5:
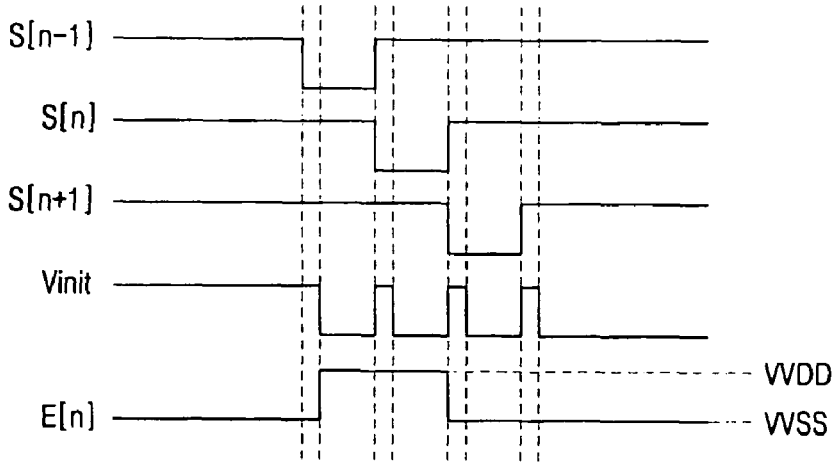
FIG. 5 shows a timing diagram illustrating an operation of the emission control circuit of FIG. 4.

FIG. 5 is a timing diagram illustrating an operation of the emission control circuit of FIG. 4.

The operation of the emission control circuit according to the second embodiment of the present invention will be described with reference to FIG. 4 and FIG. 5.

First, when an initializing signal Vinit having a high level is applied, the transistor M7 is turned off, thereby electrically disconnecting the positive power supply voltage VVDD from the first signal transmitting portion 211. At the same time, the $(n-1)^{th}$ scan signal S[n−1] having a low level is applied, and thus the transistors M1 and M3 are turned on. Therefore, the voltage applied to the second electrode B of the capacitor CAB is equal to the first electrode A, and a low level emission control signal is generated in the first electrode A of the capacitor CAB.

Then, when the initializing signal Vinit having a low level is applied, the transistor M7 is turned on while the transistors M1 and M3 are turned on. Thus, the positive power supply voltage VVDD is applied between both the electrodes of the capacitor CAB, so that the emission control signal having a high level, corresponding to the positive power supply voltage VVDD, is generated in the first electrode A of the capacitor CAB.

Next, when the $n^{th}$ scan signal Sn having a low level is applied and the initializing signal Vinit having the high level is applied, the transistor M7 is turned off and the transistors M2 and M4 are turned on. According to the turned off transistor M7, the positive power supply voltage VVDD isn't supplied the first signal transmitting portion 211, so that both the electrodes of the capacitor CAB is constantly maintained in the positive power supply voltage VVDD.

Next, when the $n^{th}$ scan signal Sn having a low level is applied and the initializing signal Vinit having the low level is applied, the transistor M7 is turned on, and the transistors M2 and M4 are turned on. Therefore, a voltage applied between both the electrodes of the capacitor CAB is constantly maintained in the positive power supply voltage VVDD even though the transistors M1 and M3 are turned off, so that the emission control signal having a high level, corresponding to the positive power supply voltage VVDD, is generated in the first electrode A of the capacitor CAB.

Last, when the $(n+1)^{th}$ scan signal S[n+1] having a low level is applied, the transistors M1, M2, M3 and M4 are turned off and the transistor M5 is turned on. Therefore, the negative power supply voltage VVSS is applied to the second electrode B of the capacitor CAB, and the control terminal of the transistor M6, thereby turning on the transistor M6. Thus, the negative power supply voltage VVSS is applied to the first electrode A of the capacitor CAB, so that the emission control signal having a low level corresponding to the negative power supply voltage VVSS is generated in the first electrode A of the capacitor CAB.

Consequently, the emission control circuit 210 generates a low level emission control signal En, corresponding to the negative power supply voltage VVSS, when the high level initializing signal is applied in response to the low level $(n-1)^{th}$ scan signal S[n−1], and generates a high level emission control signal En, corresponding to the positive power supply voltage VVDD, when the low level initializing signal Vinit is applied. Then, the emission control circuit 210 generates a high level emission control signal En, corresponding to the positive power supply voltage VVDD, when the low level initializing signal Vinit and the low level $n^{th}$ scan signal S[n] are applied. Last, the emission control circuit 210 generates an low level emission control signal En, corresponding to the negative power supply voltage VVSS, when the low level $(n+1)^{th}$ scan signal S[n+1] is applied.

Below, an OLED including the emission control driver according to the first exemplary embodiment of the present invention will be described.

Figure 6:
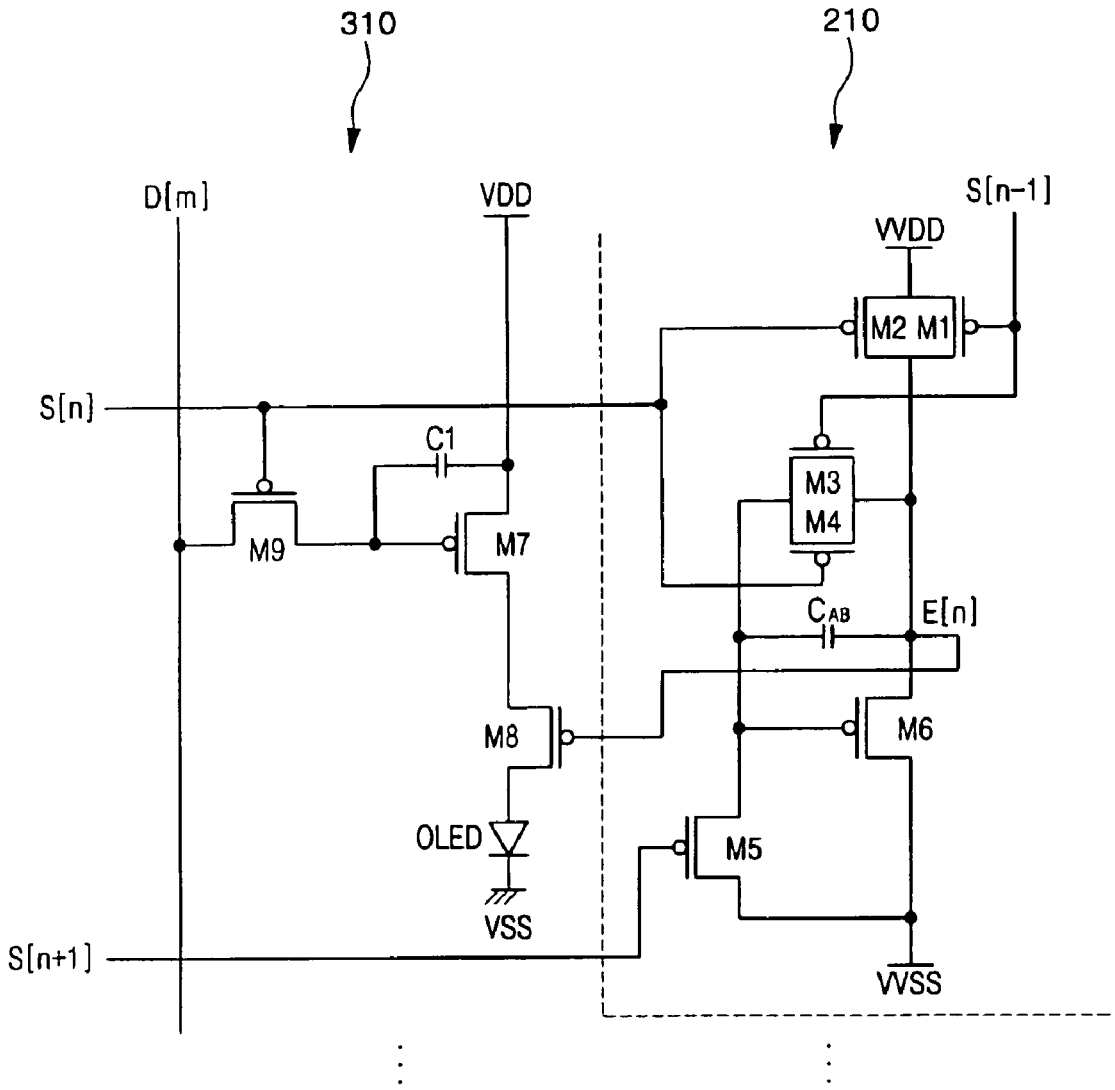
FIG. 6 shows a circuit diagram of an OLED including a pixel circuit and the emission control driver according to the first embodiment of the present invention.

For convenience, a pixel circuit 310 connected to the $m^{th}$ data line and the $n^{th}$ scan line and an emission control circuit 210 for generating the $n^{th}$ emission control signal are taken as an example and illustrated in FIG. 6.

The emission control circuit 210 of FIG. 6 is equal to that of FIG. 2, and therefore only the pixel circuit 310 will be described below.

Referring to FIG. 6, the pixel circuit 310 according to the first embodiment of the present invention includes an organic light emitting diode OLED, transistors M7, M8 and M9, and a capacitor C1.

The driving transistor M7 is used for controlling a driving current flowing through the organic light emitting diode OLED, and has an input terminal connected to a power supply voltage VDD, and an output terminal connected to an input terminal of the emission control transistor M8.

The emission control transistor M8 is connected between the driving transistor M7 and the organic light emitting diode OLED, and controls the driving current to flow or be interrupted in response to an emission control signal of an emission control line connected to a control terminal thereof.

The organic light emitting diode OLED has a cathode connected to a power supply voltage VSS, and an anode connected to an output terminal of the emission control transistor M8, and emits light corresponding to the driving current applied from the driving transistor M7.

The switching transistor M9 transmits a data voltage Vdata from the data line Dm to a first electrode of the capacitor C1 in response to the scan signal from the scan line Sn.

The capacitor C1 has a first electrode connected to a control terminal of the driving transistor M7, and a second electrode connected to the power supply voltage VDD.

Below, operations of the pixel circuit 310 in the OLED of FIG. 6 will be described with reference to the signal waveforms of FIG. 3.

First, when the $n^{th}$ scan signal S[n] having a low level is applied, the switching transistor M9 is turned on, so that the data voltage Vdata is applied to the first electrode of the capacitor C1. Therefore, the capacitor C1 is charged with an electric charge corresponding to a difference between the power supply voltage VDD and the data voltage Vdata. However, at this time, the emission control signal En has a high level, so that the emission control transistor M8 is turned off, thereby interrupting the current flowing in the organic light emitting diode OLED.

Then, when the $n^{th}$ scan signal Sn with a high level is applied and the $(n+1)^{th}$ scan signal S[n+1] with a low level is applied, the emission control signal En has a low level. When the emission control signal En with a low level is applied, the emission control transistor M8 is turned on, thereby allowing the current to flow in the organic light emitting diode OLED.

Below, an OLED including the emission control driver according to the second exemplary embodiment of the present invention will be described.

Figure 7:
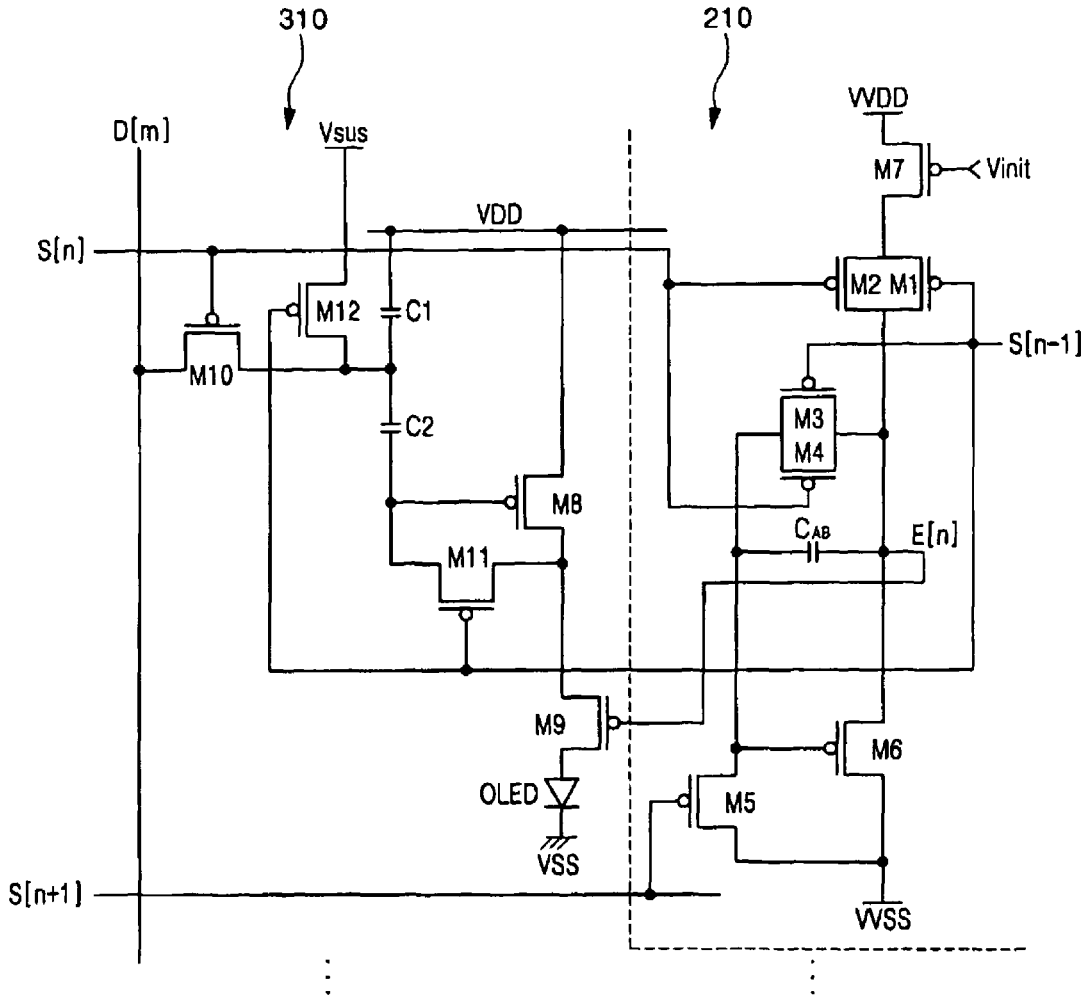
FIG. 7 shows a circuit diagram of an OLED including a pixel circuit and the emission control driver according to the second embodiment of the present invention.

For convenience, a pixel circuit 310 connected to the $m^{th}$ data line and the $n^{th}$ scan line and an emission control circuit 210 for generating the $n^{th}$ emission control signal are taken as an example and illustrated in FIG. 7.

The emission control circuit 210 of FIG. 7 is equal to that of FIG. 4, and therefore only the pixel circuit 310 will be described below.

Referring to FIG. 7, the pixel circuit 310 according to the second embodiment of the present invention includes an organic light emitting diode OLED, transistors M8, M9, M10, M11 and M12, and capacitors C1 and C2.

The driving transistor M8 is used for controlling a driving current flowing in the organic light emitting diode OLED, and has an input terminal connected to a power supply voltage VDD, and an output terminal connected to an input terminal of the emission control transistor M9.

The emission control transistor M9 is connected between the driving transistor M8 and the organic light emitting diode OLED, and controls the driving current to flow or be interrupted in response to an emission control signal applied to a control terminal thereof.

The organic light emitting diode OLED has a cathode connected to a power supply voltage VSS, and an anode connected to an output terminal of the emission control transistor M9, and emits light corresponding to the driving current applied from the driving transistor M8.

The first switching transistor M10 has an input terminal connected to the data line Dm, and transmits a data voltage Vdata to a first electrode of the capacitor C1 in response to the $n^{th}$ scan signal S[n] from the scan line Sn connected to a control terminal thereof.

The capacitor C1 has a first electrode connected to an output terminal of the first switching transistor M10, and a second electrode connected to the power supply voltage VDD.

The capacitor C2 has a first electrode connected to a control terminal of the driving transistor M8, and a second electrode connected to the first electrode of the capacitor C1.

The threshold voltage compensating transistor M11 is placed between the control terminal and the output terminal of the driving transistor M8, and causes the driving transistor M8 to be connected like a diode in response to the $(n-1)^{th}$ scan signal S[n−1].

The second switching transistor M12 is placed between an auxiliary power supply voltage Vsus and the first electrode of the capacitor C1, and applies the auxiliary power supply voltage Vsus to the first electrode of the capacitor C1 in response to the $(n-1)^{th}$ scan signal S[n−1].

Operations of the pixel circuit 310 in the OLED of FIG. 7 will be described with reference to the signal waveforms of FIG. 5.

First, the transistors M11 and M12 are turned on when the low level $(n-1)^{th}$ scan signal S[n−1] is applied, and the emission control transistor M9 is turned on when the low level emission control signal En is applied. Thus, the driving transistor M8 is connected like a diode, thereby initializing the capacitors C1 and C2.

At this time, the emission control signal En is maintained at the low level for a short time and then maintained at a high level, thereby preventing the current remaining in the driving transistor M8 from flowing to the organic light emitting diode OLED.

When the driving transistor M8 is connected like a diode, a voltage VDD−Vth is applied to the control terminal of the driving transistor M8, and the second switching transistor M12 is turned on, thereby applying the auxiliary power supply voltage Vsus to the first electrode of the capacitor C1.

Therefore, the capacitor C1 is charged with an electric charge corresponding to a difference between the power supply voltage VDD and the auxiliary power supply voltage Vsus, and the capacitor C2 is charged with an electric charge corresponding to a difference between the auxiliary power supply voltage Vsus and the voltage VDD−Vth applied to the control terminal of the driving transistor M8.

Then, when the low level $n^{th}$ scan signal S[n] is applied, the first switching transistor M10 is turned on. Therefore, the data voltage Vdata is applied to the first electrode of the capacitor C1, so that a voltage VDD−Vth−ΔV is applied to the control terminal of the driving transistor M8. Here, "ΔV" indicates a difference between the auxiliary power supply voltage Vsus and the data voltage Vdata.

Then, when the low level emission control signal En is applied, the emission control transistor M9 is turned on, so that a current I flows from the output terminal of the driving transistor M8 to the organic light emitting diode OLED, thereby allowing the organic light emitting diode OLED to emit light.

Here, the current I flowing from the output terminal of the driving transistor M8 to the organic light emitting diode OLED is obtained by the following [Equation 1].

$$I\,oled = \frac{\beta}{2}\{VDD - (VDD - Vth - \Delta V) - |Vth|\}^2 \qquad \text{[Equation 1]}$$

When "Vsus−Vdata" is substituted for "ΔV" in the [Equation 1], the current I flowing from the output terminal of the driving transistor M8 to the organic light emitting diode OLED reduces to the following [Equation 2]

$$I\,oled = \frac{\beta}{2}(Vsus - Vdata)^2 \qquad \text{[Equation 2]}$$

Here, "VDD" is the power supply voltage, "Vth" is the threshold voltage of the driving transistor M8, "Vdata" is the data voltage, and "Vsus" is the auxiliary power supply voltage. The auxiliary power supply voltage Vsus is not a substantial current source.

As shown in Equation 2, current to the OLED depends upon Vdata, the data voltage, and does not depend upon either VDD or Vth. As a result, there is no loss of voltage across the scan lines or data lines. Thus it is possible to fabricate the pixel circuit 310 in which Vth and VDD across the circuit are compensated, and there is no impact of voltage loss across the matrix of pixel circuits, or IR-drop.

The emission control drivers disclosed herein are not limited to embodiments of OLED devices with emission control drivers as shown in FIG. 6 and FIG. 7. For example, the emission control driver of FIG. 4 can be employed as the emission control driver for the OLED with the pixel circuit of FIG. 6.

According to an embodiment of the present invention, the emission control driver includes the same type transistors as those of the pixel circuit, so that the emission control circuit can be mounted in the panel instead of an external emission control driver. Therefore, the size, the weight, the production cost and the power consumption of the OLED are decreased.

Further, the scan signal, rather than an external signal, is employed for controlling the transistors, so that the layout is simplified and it is possible to use the capacitor for outputting a desired output voltage level.

Additionally, the emission control signal secures an initializing time to initialize the capacitor of the pixel circuit.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An emission control driver for transmitting control signals to a gate terminal of an emission control transistor connected to a light emitting element for controlling an emission operation of a pixel, each pixel comprising a scan line controlling a gate terminal of a scanning transistor in said pixel through the use of a scan signal transmitted by said scan line in order to provide a data signal to the pixel, the emission control driver comprising:

a first signal transmitting portion to selectively output a positive power supply voltage in response to a (n−1)th scan signal supplied to an (n−1)th scan line of a pixel and a nth scan signal supplied to an nth scan line of a pixel;

a second signal transmitting portion to selectively output a negative power supply voltage in response to a (n+1)th scan signal supplied to an (n+1)th scan line of a pixel; and an output portion connected between the first signal transmitting portion and second signal transmitting portion to selectively output the positive power supply voltage or negative power supply voltage to the emission control transistor as an emission control signal in response to the (n−1)th scan signal, nth scan signal, and (n+1)th scan signal;

wherein the first signal transmitting portion comprises:

a first switching portion for switching on or off in response to the (n−1)th scan signal and nth scan signal to receive and selectively output the positive power supply voltage; and a second switching portion for switching on or off in response to the (n−1)th scan signal and nth scan signal to selectively transmit the positive power supply voltage from the first switching portion to the output portion;

wherein the first switching portion comprises:

a first transistor with an input terminal connected to the positive power supply voltage, an output terminal connected to the second switching portion and the output portion, and a control terminal for receiving the (n−1)th scan signal; and a second transistor connected in parallel with the first transistor with an input terminal connected to the positive power supply voltage, an output terminal connected to the second switching portion and the output portion, and a control terminal for receiving the nth scan signal; and wherein the second switching portion comprises:

a third transistor with an input terminal connected to the output terminal of the first transistor, an output terminal connected to the output portion, and a control terminal for receiving the (n−1)th scan signal; and a fourth transistor connected in parallel with the third transistor with an input terminal connected to the output terminal of the first transistor, an output terminal connected to the output portion, and a control terminal for receiving the nth scan signal.

2. The emission control driver of claim 1, wherein the (n−1)th scan signal is applied to the control terminal of the first transistor and the control terminal of the third transistor.

3. The emission control driver of claim 2, wherein the $n^{th}$ scan signal is applied to the control terminal of the second transistor and the control terminal of the fourth transistor.

4. The emission control driver of claim 1, wherein the second signal transmitting portion comprises:

a fifth transistor with an input terminal connected to the negative power supply voltage, an output terminal connected to the output portion, and a control terminal for receiving the (n+1)th scan signal; and a sixth transistor with an input terminal connected to the negative power supply voltage, an output terminal connected to the output portion, and a control terminal for receiving the output signal of said fifth transistor.

5. The emission control driver of claim 4, wherein the transistors of the first signal transmitting portion and second signal transmitting portion are p-type MOSFETs.

6. The emission control driver of claim 4, wherein the transistors of the first signal transmitting portion and second signal transmitting portion are n-type MOSFETs.

7. The emission control driver of claim 4, wherein the output portion comprises a capacitor.

8. The emission control driver of claim 7, wherein the capacitor comprises:

a first electrode connected to the output terminal of the third transistor, the output terminal of the fifth transistor, and the control terminal of the sixth transistor, and a second electrode connected to the output terminal of the first transistor, the input terminal of the third transistor, and the output terminal of the sixth transistor.

9. The emission control driver of claim 8, wherein the output portion outputs an emission control signal from the second electrode of the capacitor.

10. The emission control driver of claim 7, further comprising:

an initializing transistor connected between the first switching portion and the positive power supply voltage for interrupting the positive power supply voltage to the first switching portion in response to an initializing signal.

11. The emission control driver of claim 10, wherein said initializing transistor is the same type of transistor as the transistors of the first signal transmitting portion and second signal transmitting portion.

12. An organic light emitting display (OLED), comprising:

a pixel portion comprising pixels for displaying a predetermined image thereon and comprising scan lines and data lines crossing the scan lines;

a scan driver for supplying (n−1)th, nth, and (n+1)th scan signals to (n−1)th, nth, and (n+1)th scan lines, respectively, of the pixel portion, each respective pixel of the pixel portion comprising a respective scan line controlling a gate terminal of a scanning transistor in the pixel through the use of a respective scan signal transmitted by a respective scan line in order to provide a data signal to the pixel;

a data driver for supplying a data signal to the pixel portion; and an emission control driver fabricated on the OLED panel for supplying an emission control signal to the pixel portion to control an emission operation of the pixel portion the emission control for transmitting control signals to a gate terminal of an emission control transistor connected to a light emitting element for controlling an emission operation of a pixel;

wherein the emission control driver comprises transistors of the same type as the transistors in the pixel portion, and wherein the emission control driver transistors are switched on or off in response to the (n−1)th, nth, and (n+1)th scan signals supplied by the scan driver to pixels of the pixel portion;

wherein the emission control driver comprises:

a first signal transmitting portion coupled to a positive power supply voltage to selectively output a positive power supply voltage in response to the (n−1)th and nth scan signals supplied to respective pixels:

a second signal transmitting portion coupled to a negative power supply voltage to selectively output a negative power supply voltage in response to the (n+1)th scan signal supplied to a pixel; and an output portion connected between the first signal transmitting portion and second signal transmitting portion to selectively receive said positive power supply voltage or said negative power supply voltage, and to selectively output said emission control signal in response to said positive power supply voltage or said negative power supply voltage;

wherein the first signal transmitting portion comprises:

a first switching portion for switching on or off in response to the (n−1)th scan signal and nth scan signal to receive and selectively output the positive power supply voltage; and a second switching portion for switching on or off in response to the (n−1)th scan signal and nth scan signal to selectively transmit the positive power supply voltage from the first switching portion to the output portion;

wherein the first switching portion comprises:

a first transistor with an input terminal connected to the positive power supply voltage, an output terminal connected to the second switching portion and the output portion, and a control terminal for receiving the (n−1)th scan signal; and a second transistor connected in parallel with the first transistor with an input terminal connected to the positive power supply voltage, an output terminal connected to the second switching portion and the output portion, and a control terminal for receiving the nth scan signal; and wherein the second switching portion comprises:

a third transistor with an input terminal connected to the output terminal of the first transistor, an output terminal connected to the output portion, and a control terminal for receiving the (n−1)th scan signal; and a fourth transistor connected in parallel with the third transistor with an input terminal connected to the output terminal of the first transistor, an output terminal connected to the output portion, and a control terminal for receiving the nth scan signal.

13. The organic light emitting display of claim 12, wherein the emission control driver further comprises:

an initializing transistor connected between the first signal transmitting portion and the positive power supply voltage for interrupting the positive power supply voltage from the first signal transmitting portion in response to an initializing signal.

14. The organic light emitting display of claim 13, wherein the transistors of the first signal transmitting portion, second signal transmitting portion, and the initializing transistor are p-type MOSFETs.

* * * * *